United States Patent [19]

Huemer et al.

[11] Patent Number: 4,606,302

[45] Date of Patent: Aug. 19, 1986

[54] THERMOSTAT INSERT FOR THE COOLING CIRCULATION OF LIQUID-COOLED INTERNAL COMBUSTION ENGINES

[75] Inventors: Gerhart Huemer, Ismaning; Athanasios Michassouridis, Munich, both of Fed. Rep. of Germany

[73] Assignee: Bayerische Motoren Werke Aktiengesellschaft, Fed. Rep. of Germany

[21] Appl. No.: 685,260

[22] Filed: Dec. 24, 1984

[30] Foreign Application Priority Data

Dec. 24, 1983 [DE] Fed. Rep. of Germany ..... 3347002

[51] Int. Cl.[4] ..... F01P 7/16

[52] U.S. Cl. ..... 123/41.1; 236/34.5

[58] Field of Search ..... 123/41.08, 41.09, 41.1; 236/34.5; 237/101 A, 101 B, 101 C

[56] References Cited

U.S. PATENT DOCUMENTS 3,313,483 4/1967 Nallinger ..... 236/34.5
3,768,731 10/1973 Lavado ..... 236/34.5
3,877,443 4/1975 Henning et al. ..... 123/41.1

FOREIGN PATENT DOCUMENTS 861937 1/1953 Fed. Rep. of Germany .
1451669 6/1963 Fed. Rep. of Germany .
2755463 5/1979 Fed. Rep. of Germany ..... 236/34.5

*Primary Examiner*—William A. Cuchlinski, Jr.
*Attorney, Agent, or Firm*—Craig & Burns

[57] ABSTRACT

A temperature insert for a cooling medium mixing thermostat of internal combustion engines includes, in addition to a first expansion capsule arranged in the mixing space and supported at the housing by way of a piston rod, a second expansion capsule; the first expansion capsule thereby has a higher actuating temperature than the second expansion capsule and carries both a radiator return valve as also a by-pass valve which cooperate alternately with their respective valve seats. The second expansion capsule is exposed to the temperature of the cooling medium in the radiator return line and actuates by way of a common piston rod the radiator return valve and the by-pass valve by movement of the first expansion capsule when the temperature in the radiator return line reaches the actuating temperature of the second expansion capsule. As a result the regulating temperature of the cooling medium fed to the engine is lowered at higher outside temperature and/or engine load compared to the curve resulting from the function of the first expansion capsule.

12 Claims, 2 Drawing Figures

Figure 1:
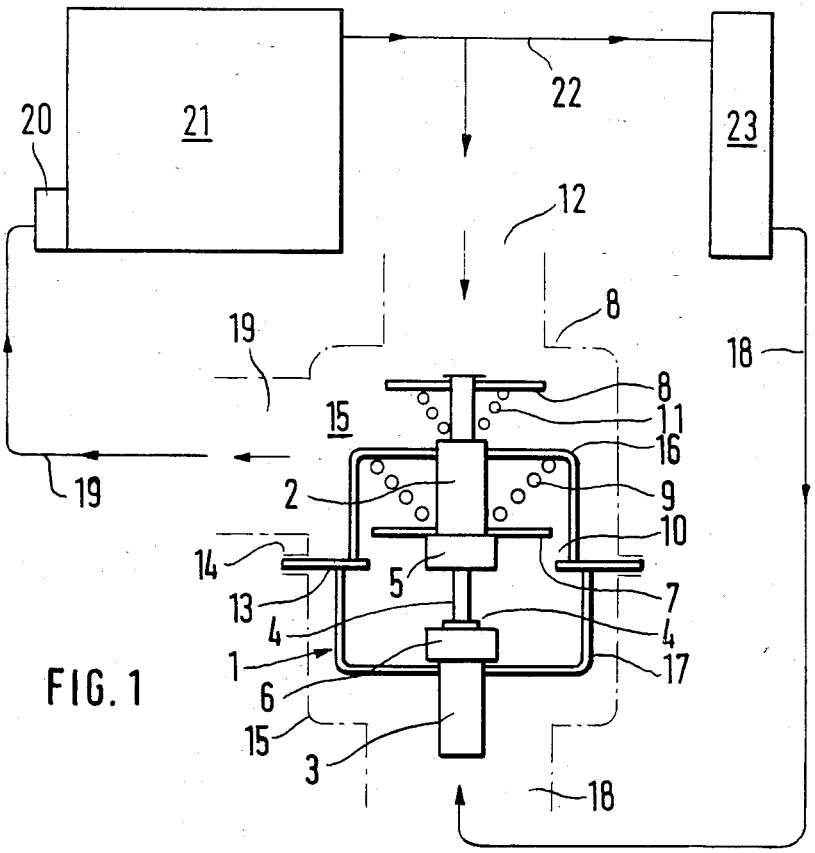

THERMOSTAT INSERT FOR THE COOLING CIRCULATION OF LIQUID-COOLED INTERNAL COMBUSTION ENGINES

The present invention relates to a thermostat insert for a cooling medium-mixing thermostat in the cooling circulation of liquid-cooled internal combustion engines.

A known insert of this type of construction according to the DE-PS No. 12 95 255 includes an expansion capsule which extends partially through the radiator return valve. As a result thereof, the temperature in the radiator return line influences the regulating temperature in the sense that with a decreasing temperature of the radiator return, the regulating temperature rises because the main part of the expansion capsule which is arranged downstream of the radiator return valve in the mixing area with the hot by-pass flow thereby has to be acted upon with increasing temperature in order to influence the expansion capsule overall with its actuating temperature. As a result thereof, a regulating temperature of the mixing flow which remains constant or continuously decreases with increasing radiator return temperature can be achieved, which is fed to the engine. The limit values of the temperature-regulating range are thereby determined, on the one hand, by a maximum value of the regulating temperature at extremely low outside temperature and low engine load and, as a result thereof, at extremely low radiator return temperature and, on the other, by a relatively low regulating temperature at high outside temperature and high engine load with high radiator return temperature, whereby the latter corresponds far-reachingly to the actuating temperature of the expansion capsule.

It is the object of the present invention to so further develop a thermostat insert of the known type of construction that at partial load of the engine with corresponding low radiator return temperature, it adjusts to a high regulating temperature remaining constant within narrow limits and at full load of the engine with corresponding high radiator return temperature, it adjusts to a lower regulating temperature. In this manner, a control is to be achieved which enables, on the one hand, a reduced friction power with reduced fuel consumption owing to a high operating temperature of the engine in the partial load operation and, on the other, a more intensive cooling for avoiding an overheating and especially auto-ignitions at full load of the engine owing to a lower operating temperature.

The underlying problems are solved in a suprisingly simple manner in that, in addition to a first expansion element consisting of a first expansion capsule and a piston rod, a second expansion capsule of a second expansion element is arranged between the piston rod and the fixed support place thereof at the housing which has a lower actuating temperature compared to the actuating temperature of the first expansion element. The expansion capsule of the first expansion element brings about a uniform, relatively high regulating temperature and the further expansion capsule of the second expansion element overrides the function of the first expansion element beginning with a relatively high temperature in the radiator return line. A decrease of the regulating temperature within the range of the full load of the engine will result therefrom to the actuating temperature of the second expansion capsule and to the following curve of the radiator return temperature with an open radiator return valve and a closed by-pass valve corresponding to the full cooling action of the radiator.

In a preferred embodiment of the present invention, the expansion capsule of the first expansion element is thereby adjusted to an opening beginning of the radiator return valve at about 90° C. to about 100° C. and the expansion capsule of the second expansion element is thereby matched to this opening beginning at about 60° C. to about 80° C. These values provide within customary limits, on the one hand, a favorable high temperature level for low friction power of the engine at partial load of the engine and, on the other, a sufficient distance of the operating temperature from critical values at full load.

According to further features of the present invention which will be described in detail hereinafter, the temperature insert is thereby so constructed that it closely follows the commercial construction of thermostat inserts so that only slight changes in pre-existing manufacturing machinery are required for a manufacture in accordance with the present invention.

The German Pat. No. 861,937 already discloses the concept of adjusting the support location of a thermostat expansion element on the side of the housing as a function of the load of the engine; however, structurally costly mechanical or pneumatic transmissions for the linkage movements, respectively, suction pressure transmission are necessary therefor. In contrast thereto, in the present invention, the load dependence of the radiator outlet temperature is utilized directly as regulating magnitude accompanied by low structural expenditures.

Furthermore, the German Offenlegungsschrift No. 14 51 669 discloses in connection with a thermostat to arrange two expansion capsules on both sides of a radiator inlet valve of a thermostat arranged at the bifurcation of radiator inlet and by-pass line and controlling this bifurcation and to construct the same with different actuating temperatures. In contrast to the thermostat in accordance with the present invention which is arranged as mixing thermostat at the discharge of the radiator return line and by-pass line, a direct automatic influencing of the control function by the temperature in the radiator return line is not possible in this prior art construction. Consequently, there is no suggestion for the present invention in this prior art patent.

Figure 2:
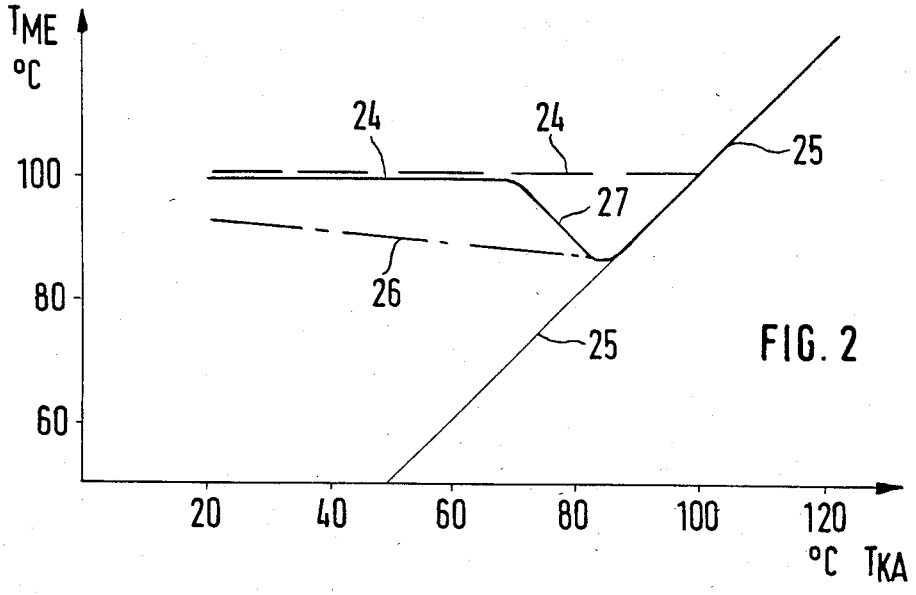

These and other objects, features and advantages of the present invention will become more apparent from the following description when taken in connection with the accompanying drawing which shows, for purposes of illustration only, one embodiment in accordance with the present invention, and wherein:

FIG. 1 is a somewhat schematic view of a thermostat insert in accordance with the present invention in its arrangement in a cooling circulatory system of an internal combustion engine; and FIG. 2 is the control curve of the thermostat insert according to FIG. 1 in comparison with the control curves of prior art thermostats.

Referring now to the drawing, and more particularly to FIG. 1, a thermostat insert generally designated by reference numeral 1 consists of two mutually oppositely directed expansion capsules 2 and 3 having a common piston rod 4 and a sealing cap 5 and 6 each, which form two expansion elements with different actuating temperatures. The first expansion capsule 2 carries a radiator return valve 7 and a by-pass valve 8. The radiator return valve 7 is fixed on the expansion capsule 2 and is urged together with the latter in the direction toward a valve seat 10 by a return spring 9. The by-valve 8 is axially displaceably supported at the opposite end of the expansion capsule 2 against the action of a further return spring 11 so that the stroke of the expansion capsule 2 is not limited when the by-pass valve 8 rests against its valve seat 8' leading to the by-pass line 12. The valve seat 10 is constructed on a radial fastening and closure flange 13 which is retained along its outer circumference in a flange connection 14 of a thermostat housing 15. Both the return spring 9 as also the second expansion capsule 3 are supported at the flange 13 and therewith at the thermostat housing 15 by way of a respective U-shaped support element 16 and 17. The expansion capsule 3 thereby extends into a radiator return line 18 which is connected to the thermostat housing 15 and continues within the thermostat housing 15 up to the valve seat 10. The oppositely disposed by-pass line 12 which discharges into the housing 15 terminates at the valve seat 8' for the by-pass valve 8.

The interior space of the housing 15 forms intermediate the valve seats 8' and 10' a mixing chamber 15' for cooling medium proportions from the by-pass line 12 and the radiator return line 8. A return line 19 leads from the mixing space 15' to the cooling medium pump 20 of the engine 21. The by-pass line 12 and a radiator inlet line 22 leading to a radiator 23 with the adjoining radiator return line 18 close the two parallel line branches of the cooling medium circulation between engine 21 and mixing chamber 15.

During the operation of the engine 21, the cooling medium pump 20 supplies the cooling medium which is initially cold after a cold start, exclusively through the by-pass line 12 with an opened by-pass valve 8 and a closed radiator return valve 7. Since a cooling action of the radiator 23 is precluded thereby, the temperature of the cooling medium reaches rapidly the actuating temperature of the expansion capsule 2 which is arranged predominantly in the mixing space 15' through which the cooling medium flows. The expansion material contained in the expansion capsule 2 thereby expands very considerably at its actuating temperature by a change of its aggregate condition from solid into liquid within a small temperature range of, for example, 90° to 105° C. As a result thereof, a stroke of the expansion capsule 2 together with the radiator return valve and the by-pass valve 10 is produced within this temperature range which effects, on the one hand, at 90° C. the opening of the radiator return valve 7 and, on the other hand, at 105° C. the closing of the by-pass valve 8. The common piston rod 4 of the two expansion capsules 2 and 3 is thereby displaced out of the expansion capsule 2 by the volumetric change of the expansion material within the expansion capsule 2 against the action of the return spring 9 and rests by way of an abutment ring 4' against the second expansion capsule 3. The abutment ring 4' thereby forms a fixed support for the piston rod 4 whose position thereby remains uninfluenced by the volumetric change of the expansion material in the second expansion capsule 3 below the beginning of its acutuating temperature range of, for example, 70° to 85° C. As a result thereof, an overriding of the control function of the first expansion capsule 2 by the second expansion capsule 3 is avoided when the radiator return temperature dependent on the outside temperature and on the engine load lies between the respective outside temperature and the beginning of the actuating temperature range of the second expansion capsule of about 70° C.

As a result of the proportional influence of the temperature of the cooling medium in the mixing space 15' on the main portion of the expansion capsule 2 arranged therein, and in the radiator return line 8 on the sealing head 5 of the expansion capsule 2 arranged therein, a curve 24 in FIG. 2 of the regulating temperature results therefrom and therewith of the engine inlet temperature $T_{ME}$ with a nearly constant value at varying radiator outlet temperature $T_{KA}$ as is indicated in FIG. 2 by the curve 24 in full line. This curve 24 of the regulating temperature which stems alone from the function of the expansion capsule 2, passes over in a known manner according to the dash line 24' directly into the curve 25 of the radiator outlet temperature $T_{KA}$ with full through-flow of the radiator 23 and with closed-off by-pass line 12. If the regulating temperature and therewith the engine inlet temperature $T_{ME}$ is thereby chosen relatively high according to the curve 24–24' in FIG. 2 with about 100° C. in order to achieve at engine partial load a high operating temperature advantageous for low friction power, then this leads at the same time with simultaneously prevailing high outside temperature and engine full load to overheating and auto-ignition dangers of the engine within the range 24'.

If the influence of the part of the expansion element 2 arranged in the radiator return line is increased in an also known manner, then this leads to a curve 26 of the regulating temperature with values decreasing with increasing radiator outlet temperature $T_{KA}$, as is indicated in FIG. 2 by the dash-and-dotted line 26. The engine inlet temperature $T_{ME}$ is thereby increasingly reduced already over the entire regulating range at engine partial load which leads to loss in efficiency of the engine above all by increased friction work, in particular, at middle up to high partial load.

In the present invention, the second expansion capsule 3 which is additionally arranged according to FIG. 1 in the radiator return line 18 and is exposed to the radiator outlet temperature $T_{KA}$ of the cooling medium, effects a decreasing curve 27 of the regulating temperature and therewith of the engine inlet temperature $T_{ME}$ only with the beginning of the actuating temperature range of, for example, 70° C. to 85° C. of this second expansion capsule 3 which is reached only at high partial load and full load of the engine and with simultaneous high outside temperature. The piston rod 4 is thereby displaced out of the sealing head 6 by the volumetric increase of the expansion material in the second expansion capsule 3 and therewith also the first expansion capsule 2 together with the radiator return valve 7 and the by-pass valve 8 is displaced in the sense of an increasing opening of the former and closing of the latter. A decrease of the cooling medium temperature in the mixing space 15 results therefrom with simultaneous further increase of the radiator return temperature $T_{KA}$. A negative stroke of the piston rod 4 with respect to the first expansion capsule 2 follows from this temperature reduction. The hotter non-cooled cooling medium proportion which continues to flow in decreasing proportion out of the by-pass line 12 thereby prevents by its influence on the expansion capsule 2 together with the time-delayed conversion of the temperature change in the expansion capsule 2 an excessively rapid closing function of this first expansion capsule 2 with respect to the simultaneous opening function of the second expansion capsule 3. A further equalization of the mutually opposite strokes is achieved thereby and a control oscillation by reason of the overlapping ranges of the actuating temperatures of both expansion capsules 2 and 3 is avoided thereby. A matching of the actuating temperatures and control strokes of the two expansion capsules 2 and 3 to the respectively existing circulation contributes thereto.

At a radiator return temperature $T_{KA}$ in the radiator return line 18 of about 85° C., the expansion capsule 3 reaches a stroke of the piston rod 4 which alone corresponds to the full opening of the radiator return valve 7 and the full closing of the by-pass valve 8. The first expansion capsule 2 is thereby acted upon also exclusively by the radiator return temperature $T_{KA}$ from the radiator return line 8 with about 85° C. so that the piston rod 4 has its starting position relative to the first expansion capsule 2 and the position of the valves 7 and 8 is thus dependent exclusively on the stroke of the piston rod 4 out of the second expansion capsule 3. For a further increase of the radiator outlet temperature $T_{KA}$ along the curve 25 in FIG. 2, a sufficient free movement of the support element 16 and of the by-pass valve 8 with respect to the expansion capsule 2 as well as a sufficient travel of the return springs 9 and 11 are provided corresponding to the function of the two expansion capsules 2 and 3.

As a result of the function of the second expansion capsule 3, the regulating temperature and therewith the engine inlet temperature $T_{ME}$ drops within the range of the actuating temperature of 70° C. to 85° C. of the second expansion capsule 3 from its horizontal curve 24, which is determined by the function of the first expansion capsule 2, with an increasing radiator outlet temperature $T_{KA}$ to the curve 25 of the radiator outlet temperature $T_{KA}$ with a through-flow of the cooling medium only through the radiator 23. Subsequently, the operating temperature further increases as a function of the outside temperature and of the engine load, whereby solely the cooling capacity of the cooling circulation and thereby in particular the radiator size are exclusively determinative for the temperature values of this increase according to curve 25.

The curve of the cooling medium temperature which is attainable by the present invention in cooperation with a matching of the entire cooling circulation, enables the attainment in internal combustion engines, on the one hand, of a particularly high operating temperature for a high efficiency in the partial load range and, on the other, a lower operating temperature for a totally dangerless full-load operation by means of extraordinarily low structural expenditures for the thermostat insert according to the present invention. Also, an exchange of a heretofore customary thermostat insert in internal combustion engines equipped with mixing thermostats for a thermostat insert matched in accordance with the present invention to the respective internal combustion engine is possible in a simple manner.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A thermostat insert for a cooling medium mixing thermostat means in a cooling circulatory system for liquid-cooled internal combustion engines, comprising a radiator return valve means for a radiator return line, a by-pass valve means for a by-pass line, a first expansion means having a first actuating temperature and including a first expansion capsule and a piston rod means, the first expansion capsule being operatively connected with both valve means and being arranged substantially between said two valve means, a valve housing means, the piston rod means effectively forming a connection to a support means in the housing means, which is arranged opposite the first expansion capsule in relation to the radiator return valve means, a second expansion means including a second expansion capsule arranged between the piston rod means and the support means thereof, said second expansion means having a second actuating temperature which is lower compared to the first actuating temperature.

2. A thermostat insert according to claim 1, wherein the expansion capsule of the first expansion means is adjusted to an opening beginning of the radiator return valve means at about 90° to about 100° C. and the expansion capsule of the second expansion means to this opening beginning at about 60° C. to about 80° C.

3. A thermostat insert according to claim 1, comprising fastening and valve seat flange means for fastening the thermostat insert in the housing means and for forming the valve seat of the radiator return valve means, the support means including a support element as fixed support of the piston rod means of the first expansion means at the housing means, the support element extending approximately U-shaped in cross section between its fastening places at the flange means, the support element being constructed as abutment of the expansion capsule of the second expansion means and the piston rod means of both expansion elements facing one another and being supported at one another with oppositely directed actuating movements.

4. A thermostat insert according to claim 3, wherein the piston rod means of the two expansion means are connected with each other in one piece.

5. A thermostat insert according to claim 3, wherein the piston rod means includes an abutment which supports the piston rod means in the direction toward the expansion capsule of the second expansion means when the latter has a lower temperature than corresponds to the opening beginning of the radiator return valve means by the action of the second expansion capsule.

6. A thermostat insert according to claim 5, wherein the expansion capsule of the first expansion means is adjusted to an opening beginning of the radiator return valve means at about 90° to about 100° C. and the expansion capsule of the second expansion means to this opening beginning at about 60° C. to about 80° C.

7. A thermostat insert according to claim 1, wherein the piston rod means includes an abutment which supports the piston rod means in the direction toward the expansion capsule of the second expansion means when the latter has a lower temperature than corresponds to the opening beginning of the radiator return valve means by the action of the second expansion capsule.

8. A temperature control installation for the cooling circulation of a liquid-cooled internal combustion engine, comprising a mixing thermostat means including a first expansion means arranged essentially in the cooling medium mixing flow, the mixing proportions of the cooling medium from a radiator return line and a by-pass line being controlled oppositely by respective valve means, a second expansion means arranged in the operative connection between the first expansion means which is influenced by the cooling medium mixing flow and the valve means, said second expansion means being located in the cooling medium flow from the radiator return line and actuating the valve means at a lower temperature of the cooling medium from the radiator return line than at that temperature at which the first-mentioned expansion means is actuated.

9. A cooling fluid mixing thermostat means in a cooling circulatory system for a liquid-cooled internal combustion engine wherein: a first valve means is fluidly connected to a portion of the circulatory system, which normally conducts cooling fluid from the engine to a radiator, to permit cooling fluid in that portion of the circulatory system to by-pass the radiator and go directly to an inlet of a cooling pump in the circulatory system which pumps cooling fluid to the engine; a second valve means fluidly controlling a second portion of the circulatory system which conducts cooling fluid from an outlet of the radiator to the inlet of the pump; the improvement comprising: a first temperature responsive expansion means located between and connected to both valve means and operable at a first temperature of the cooling fluid at the inlet of the cooling pump; second temperature responsive expansion means operable in response to a predetermined temperature of the cooling fluid leaving the radiator and heading toward the second valve means; the predetermined temperature for the second temperature expansion means being less than the actuating temperature for the first temperature expansion means; the second temperature expansion means being controllingly connected to both valve means when operable in response to the temperature of the fluid heading toward the second valve means exceeding the predetermined valve and when the first temperature is reached.

10. The thermostat of claim 9 wherein the first temperature is in the range of 90 degrees C. to 100 degrees C. and the predetermined temperature is in the range of 60 degrees C. to 80 degrees C.

11. The thermostat of claim 9 wherein the controlling connection between the second temperature means and both valve means includes a piston rod means extendable between the two temperature expansion means.

12. The thermostat of claim 11, wherein the piston rod means is extended by the first temperature expansion means when the first temperature is reached.

* * * * *